United States Patent [19]

Ballu

[11] Patent Number: 4,710,109

[45] Date of Patent: Dec. 1, 1987

[54] DIAPHRAGM PUMPS WITH IMPROVED STRUCTURAL COOLING AND MAINTENANCE

[75] Inventor: Patrick J. M. Ballu, Reims, France

[73] Assignee: Tecnoma, France

[21] Appl. No.: 861,235

[22] Filed: May 8, 1986

[30] Foreign Application Priority Data

May 10, 1985 [FR] France ..... 85 07098

[51] Int. Cl.[4] ..... F04B 21/00

[52] U.S. Cl. ..... 417/454; 92/100; 417/537; 417/540

[58] Field of Search ..... 417/536, 537, 454, 540; 92/99, 100; 165/185, 80.3, 80.1; 137/454.4, 454.5, 543.17; 138/338; 411/395, 402, 403, 404, 410

[56] References Cited

U.S. PATENT DOCUMENTS

| | | | |
|---|---|---|---|
| 1,798,631 | 3/1931 | Rodler | 137/454.4 |
| 2,308,041 | 1/1943 | Babitch et al. | 417/540 |
| 2,445,978 | 7/1948 | Stellin | 411/404 |
| 2,741,187 | 4/1956 | Moller | 92/99 X |
| 2,813,450 | 11/1957 | Dzus | 411/403 |
| 3,172,369 | 3/1965 | Ballu | 417/540 X |
| 3,209,640 | 10/1965 | Waivers | 411/395 |
| 3,282,145 | 11/1966 | Prescott | 411/403 |
| 3,878,861 | 4/1975 | Pareja | 137/543.17 |
| 4,336,824 | 6/1982 | Steineman | 137/454.5 X |
| 4,607,685 | 8/1986 | Mitchell, Jr. | 165/80.3 |

FOREIGN PATENT DOCUMENTS

| | | | |
|---|---|---|---|
| 587321 | 11/1959 | Canada | 92/99 |
| 1274473 | 9/1961 | France | 92/99 |
| 5265 | of 1881 | United Kingdom | 411/403 |
| 29923 | of 1910 | United Kingdom | 417/537 |

*Primary Examiner*—Leonard E. Smith
*Attorney, Agent, or Firm*—Darby & Darby

[57] ABSTRACT

A diaphragm pump has at least one double-acting piston moving in a cylinder closed at its ends by diaphragms and filled with oil. The diaphragms are capped by cylinder heads defining the chambers in which warping of the diaphragms produces the suction and discharge of liquid to be pumped through suction and discharge tubes each having a one-way valve therein. The diaphragms are centrally connected to the piston ends by screws whose screw heads have the form of a large diameter, concave metal cup. The screw head concavity faces the cylinder heads and has an internal surface provided with, for example, annular reliefs, ensuring a large contact surface between the screw heads and the pumped cooling liquid.

18 Claims, 4 Drawing Figures

Figure 1:
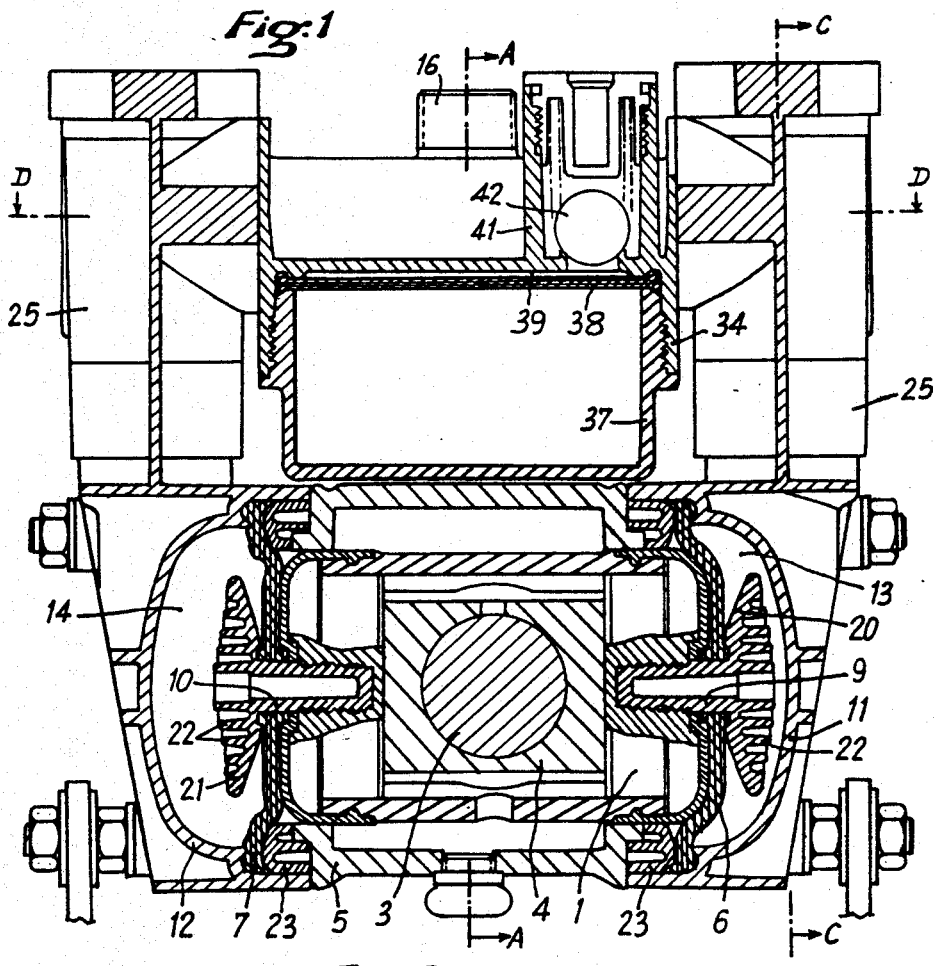

35
15
B
36
1
3
4
5
B
2

26
32
33
31
31
33
32
27
28
43
24
17
29
43
25
18
43
43
43

DIAPHRAGM PUMPS WITH IMPROVED STRUCTURAL COOLING AND MAINTENANCE

The present invention relates to diaphragm pumps of the tupe described in French Pat. Nos. 1,201,719 and additions No. 75,245 and 81,151 in the name of Vincent Ballu. Such pumps have a multiplicity of applications, particularly in the field of the agricultural machine for the distribution under pressure of abrasive or corrosive liquids such as those used for the treatment of plantings.

The general structure of these pumps consists of at least one double-action piston moving in a cylinder or case closed at the ends by diaphragms and filled with oil. The diaphragms which are capped by cylinder heads are warped by the action of the reciprocating piston, causing the suction and discharge of the liquid in the chambers comprised between the diaphragms and cylinder heads. The cylinder heads are connected to the suction and discharge channels by means of one-way valves such as flap or reciprocating valves.

These pumps are subjected to very rigorous conditions of use and they have to be simultaneously expensive, robust, dependable and long-lived, in spite of minimal maintenance which must, moreover, be easy and fast to accomplish.

Such conditions are relatively difficult to combine in spite of advances in technology. In particular, the diaphragms remain a fragile member whose longevity depends on a perfect polish on the surfaces of the cylinder on which they are fixed or on which they rest in the course of their warping, and furthermore it must be possible to disassemble and replace the one-way valves very quickly.

The pump according to the present invention is of the type with diaphragms fixed by their central zones on the ends of the piston and it is characterized in that the attachment piece has the form of a screw passing through the diaphragm and fixed in the body of the piston, the head of this screw having the form of a metal cup of large diameter whose concavity faces the cylinder head and whose surface can be provided with, preferably, annular reliefs thereby insuring the said cup a large surface relative to the volume which it occupies.

The term "large diameter cup" is used here to denote a diameteron the order of ⅔rds or ¾ths of the piston.

This arrangement insures the transfer of the heat units from the mechanical system constituted by the assembly of the piston and its reciprocating drive system by eccentric, toward the liquid being pumped, and, in combination, makes it possible to form the cylinder heads of injected plastic since the function of cooling the mechanical part is no longer insured by the conductivity of metal cylinder heads.

This also makes it possible, in combination, to insure the attachment and the locking of the diaphragms between the cylinder heads on the one hand and, on the other hand, the annular rings of molded plastic covering the annular terminal edges of the case. Such rings have a perfect surface polish owing to their very material (plastic) and to the manufacturing process (molding), insuring the longevity of the diaphragms while loweirng the manufacturing cost of the pump. This arrangement is made possible by the presence of the screw with cooling head since the edges of the cylinder no longer participate in the transfer of the heat units from the mechanical system.

Another aspect of the invention is that the one-way valves are lodged in straight sections of tubes integral with the cylinder heads and that they are held in place by simple plugs screwed at the ends of these sections.

As a result, the valves can be disassembled by simply unscrewing the plugs byhand without disassembling the pump, the sections of tube in which they are lodged being preferably made in one piece with the cylinder heads.

This makes it possible to embody the suction and discharge tubes n a block disposed and enclosed between the above sections and comprising a cylindrical housing screwed into the said block with interposition of an elastic diaphragm and thus forming the regulator or damper, known in itself, but generally of a complex design and attachment.

The pump thus obtained therefore has a structure substantially different from those known heretofore and forms a mechanical part of classic type with metal case containing the reciprocating piston on which are mounted lateral cylinder heads of injected plastic bearing twinned and parallel sections of tubes with axes perpendicular to the axis of the piston, enclosing with a block containing the suction and discharge tubes with which they communicate as well as a damper housing screwed into the block, the one-way valve being lodged in the open ends of the said sections of tubes and held in place by plugs screwed to the said ends, perhaps with interposition of internal sleeves.

A precalibrated valve is preferably placed in a communication between the discharge and suction tubes.

The invention is illustrated by the attached drawing showing an example of embodiment of a pump.

Figure 4:
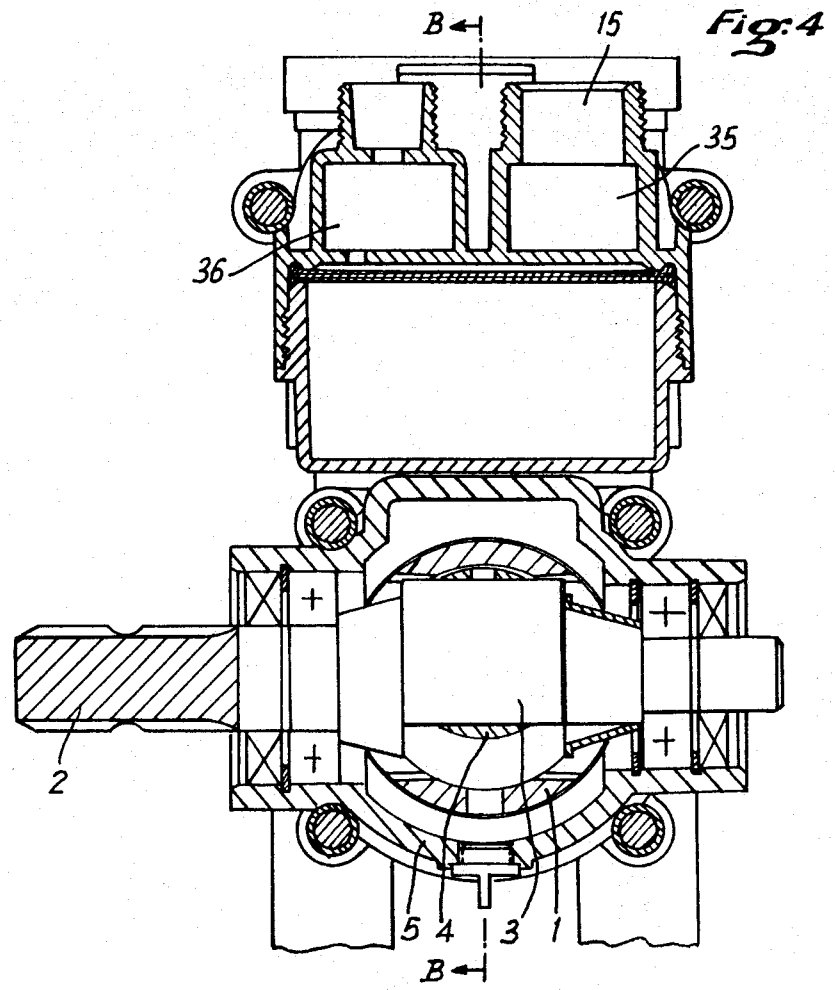

In FIG. 1, in vertical section along the axis of the piston, along BB in FIG. 4.

Figure 2:
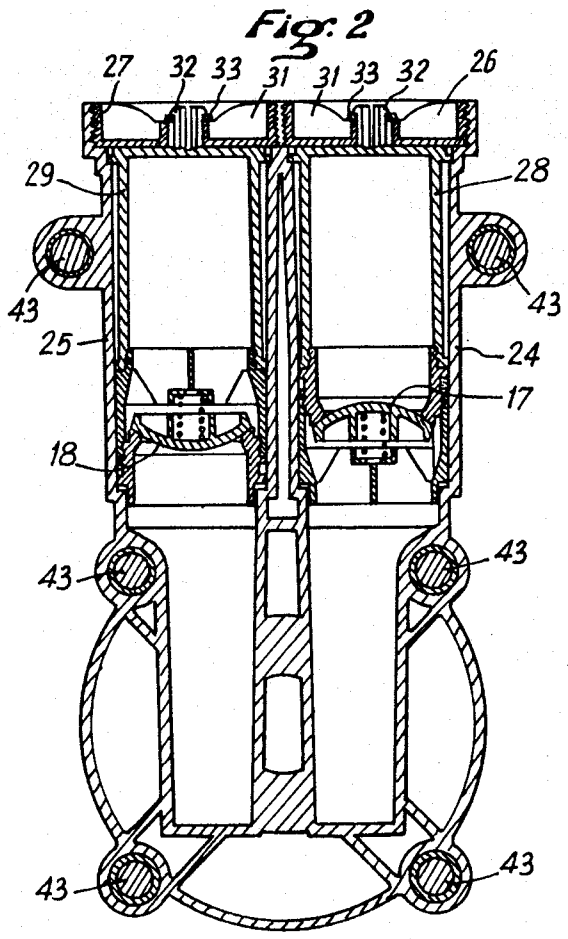

In FIG. 2, in vertical section along CC in FIG. 1.

Figure 3:
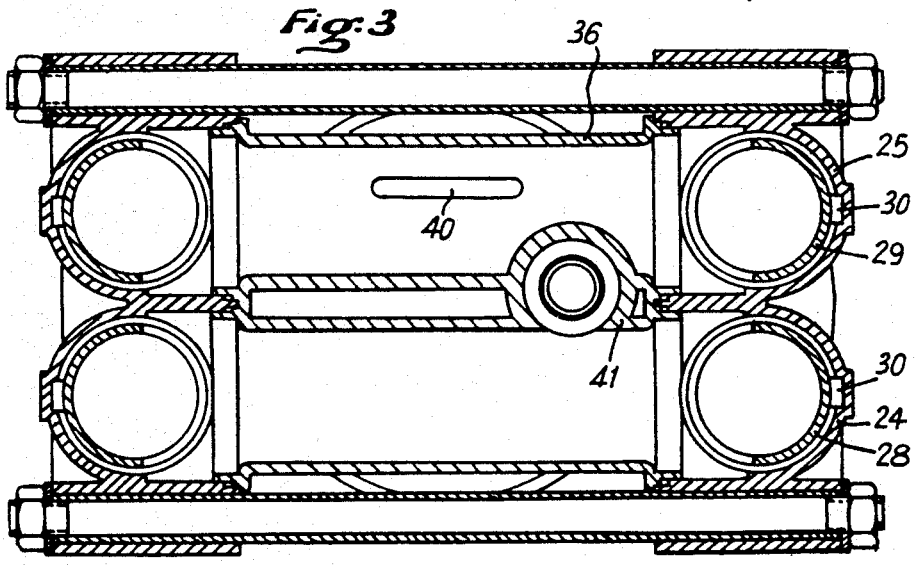

In FIG. 3, in horizontal section along DD in FIG. 1.

In FIG. 4, in vertical section, along AA in FIG. 1.

The pump represented in these figures comprises a reciprocating piston 1 driven by shaft 2 by cooperation of the eccentric 3 and the cam-wheel 4 sliding in the piston 1. This double-acting piston moves in the cylinder-case 5 closed at its ends by diaphragms 6 and 7 held by screws 9 and 10 on the piston heads. This volume is closed and filled with oil. The diaphragms 6 and 7 are enclosed on the ends of case 5 by the cylinder heads 11 and 12 which delimit the chambers 13 and 14 with variable volume. The warping of diaphragms 6 and 7 by the movements of piston 1 produce an effect of suction and discharge in chambers 13 and 14 which communicate with the suction 15 and discharge 16 by means of tubes in which one way suction and discharge one way valves 17, 18 are placed. Such one-way valves may be flap valves, or as depicted in the figures, reciprocating valves. This general structure is known in itself.

According to the invention, the screws 9 and 10 are made of metal and have heads 20, 21 in the form of a large-diameter cup with concavity facing the cylinder heads 11 and 12 (opposite the threaded parts); when the actual surface of the cups is not sufficient by itself to insure the transfer of the heat units, these cups can be provided with reliefs of large surface, of any shape whatever but preferably with a clearance permitting their unmolding, and preferably annular. The general cuplike shape prevents the heads 20, 21 from being in contact with the diaphragms over their entire surface; the reliefs 22 increase the heat-exchange surface between the cups and the liquid being pumped in the chambers 13, 14.

The screwheads 20, 21 can be of various shapes, particularly with regard to the reliefs 22, the important thing being that by their elevated surface they insure the transfer of the heat units from the mechanical part 1 to 5 towards and intot heliquid contained in the chambers 13 and 14, and thus serve the function of "radiators".

Therefore this function no longer has to be served by cylinder heads 11 and 12, made of metal (aluminum) and having an elevated surface of contact with the case 5. These cylinder heads will therefore preferably be made of plastic with interposition between the diaphragms 6 and 7 and the ends of the case 5, of inserted rings 23 preferably of molded plastic, whose surface in contact with the diaphragms therefore has a perfect polish.

Thus the manufacture of case 5 is greatly simplified since it is no longer necessary to polish the rounded surfaces of the case in contact with the diaphragms, but only the surfaces of the rings 23.

Furthermore, the surfaces of the piston heads in contact with the diaphragms are better cooled, which likewise contributes to the longevity of the diaphragms.

The cylinder heads 11, 12 bear sections of suction and discharge tube 24 and 25, preferably twinned, inside which are lodged the one-way valves 17 and 18. The ends of the sections 24 and 25 are open and the one-way valves 17 and 18 are held in place by simple plugs 26, 27 screwed into these ends with, in the example represented, interposition of bracing sleeves 28, 29 inserted in tubes 24, 25 (smaller diameter).

It thus becomes possible to check, repair or change the one-way valves without disassembling the pump and by simply unscrewing the plugs 26, 27 by hand.

In the example represented, the sleeves 28, 29 have a stud 30 cooperating with a groove in the tubes 24, 25 and preventing the sleeves from rotating. The plugs 26, 27 have vanes 31 for screwing and they are mounted rotatably on sleeves 28, 29 by means of heads 32 and clip-rings 33.

In this variation,the one-way valves 17, 18 are fixed at the end of sleeves 28, 29 which in turn are attached to plugs 26, 27 so that the extraction of the latter involves that of the one-way valves themsleves.

In this variation likewise, the sections 24, 25 are molded in one piece with the cylinder heads 11, 12.

The suction tubes 15, 35 and discharge tubes 16, 36 are twinned and form a block interposed and inserted between the two groups of twinned sections integral with cylinder heads 11, 12. This block includes the damping or regulating volume formed by the housing which is cylindrical, as with an external thread and assembled by screwing into skirt 34 of the block, with interposition of the diaphragm 38.

The discharge tube 36 communicates with the space 39 above the diaphragm 38 through the longitudinal slot 40, and the space 39 communicates with the suction tube 35 through duct 41 on which there is a precalibrated ball valve 42 serving as a safety valve.

The structure of the pump thus embodied is therefore clearly different from previous embodiments: on a classic mechanical block 1 to 7 are mounted two lateral assemblies of plastic, comprising the cylinder heads 11, 12 and the sections of tubes 24, 25 containing the one-way valves 17, 18 directly accessible by plugs 26, 27. Between these sections 24, 25 is inserted a block formed of suction tubes 35, 36. and the damper housing 37. The assembly is embodied by parallel stay-rods 43, four of which are placed at the level of the mechanical part and two at the level of tubes 35, 36. No disassembly of the pump is necessary in order to reach the one-way valves, and the mere disassembly of stay-rods 43 insures the complete disassembly of the pump.

What is claimed is:

1. A diaphragm attachment screw for a diaphragm pump, characterized in that the head thereof has the form of a metal cup of large diameter with concavity facing opposite the threaded part and whereof the surface is provided with a plurality of annular reliefs insuring that the cup has a large surface relative to the volume which it occupies.

2. A one-way valve for a diaphragm pump, characterized in that it is mounted at one end of a bracing sleeve having at its other end, a threaded plug attached rotatably on the sleeve, said bracing sleeve further having an outer stud for cooperating with a groove in an inner wall of a tube of the diaphragm pump into which said bracing sleeve is placed, in order to prevent rotation of said sleeve within said tube, whereby said valve and sleeve may be easily removed from said tube by unscrewing said threaded plug.

3. A diaphragm pump comprising at least one double-acting pistion moving in a cylinder closed at its ends by diaphragms and filled with oil, the diaphragms being capped by cylinder heads definign chambers characterized in that each cylinder head is integral with a pair of parallel straight tubes, said tube shaving inlet and outlet one-way valves, respectively, each said valve being mounted at one end of a non-pivotable bracing sleeve within each said tube, the other end of said sleeve being threadedly connected to the respective tube.

4. A pump according to claim 3, characterized in that the suction and discharge tubes form a block enclosed between two pairs of sections of tubes, said block incorporating a regulator housing with interposition of a diaphragm.

5. A diaphragm pump comprising at least one double-acting piston moving in a cylinder closed at its end by diaphragms and filled with oil, the diaphragms being capped by cylinder heads defining chambers in which warping of the diaphragms produces suction and discharge of the liquid to be pumped in suction and discharge tubes in which one-way valves are mounted, characterized in that the diaphragms are fixed on central zones of ends of the piston by screws whose heads have the shape of a metal cup of large diameter, with concavity facing the cylinde heads and whose inner surface has a plurality of annular reliefs, insuring that the cups have a large surface of contact with the liquid to be pumped.

6. A pump according to claim 5, characterized in that the suction and discharge tubes form a block enclosed between two pairs of sections of tubes said block incorporating a regulator housing with interposition of a diaphragm.

7. A pump according to claim 6, in which the housing is cylindrical, incorporates an outside thread and is mounted by screwing into a threaded skirt in the block of tubes with interposition of an elastic diaphragm.

8. A pump according to claim 5, characterized in that the diaphragms are enclosed between the cylinder heads and a cylinder case by means of added rings of molded plastic covering the annular terminal edges of the cylinder case.

9. A pump according to claim 8, characterized in that the suction and discharge tubes form a block enclosed between two pairs of sections of tubes, said block incorporating a regulator housing with interposition of a diaphragm.

10. A pump according to claim 8, characterized in that the one-way valves are lodged in straight sections of tubes, integral with the cylinder heads and held in place by plugs screwed on the ends of the sections.

11. A pump according to claim 10, characterized in that the one-way valves are mounted at the end of sleeves inserted in the sections.

12. A pump according to claim 11, characterized int hat the sleeves are fixed rotatably on the plugs.

13. A pump according to claim 5, characterized in that the one-way valves are lodged in straight sections of tubes, integral with the cylinder heads and held in place by plugs screwed ont he ends of the said sections.

14. A pump according to claim 13, characterized in that the suction and discharge tubes form a block enclosed between two pairs of sections of tubes, said block incorporating a regulator housing with interposition of a diaphragm.

15. A pump according to claim 13, characterized in that the one-way vlves are mounted at tne end of sleeves inserted in the sections.

16. A pump according to claim 15, characterized in that the suction and discharge tubes form a block enclosed between two pairs of sections of tubes, said block incorporating a regulator housing with interposition of a diaphragm.

17. A pump according to claim 15, characterized in that the sleeves are fixed rotatably on the plugs.

18. A pump according to claim 17, characterized in that the suction and discharge tubes form a block enclosed between two pairs of sections of tubes, said block incorporating a regulator housing with interposition of a diaphragm.

* * * * *